United States Patent [19]

Malone et al.

[11] 4,290,751

[45] Sep. 22, 1981

[54] BLAST FURNACE STOVE

[75] Inventors: William H. Malone, Northfield; John Fischley, Chagrin Falls; Harry L. Anderson, Brecksville; Edward J. Spirko, Broadview Heights, all of Ohio

[73] Assignee: Republic Steel Corporation, Cleveland, Ohio

[21] Appl. No.: 92,447

[22] Filed: Nov. 8, 1979

[51] Int. Cl.[3] ..... C21B 9/00; F24H 7/00

[52] U.S. Cl. ..... 432/214; 432/217

[58] Field of Search ..... 432/214, 217, 218, 247

[56] References Cited

U.S. PATENT DOCUMENTS

| | | | |
|---|---|---|---|
| 1,021,851 | 4/1912 | Strale . | |
| 1,079,764 | 11/1913 | Hohmann . | |
| 1,983,017 | 12/1934 | Bowland . | |
| 2,049,816 | 8/1936 | McGee . | |
| 2,187,191 | 1/1940 | Younglove | 432/217 |
| 2,428,461 | 10/1947 | Kinney et al. . | |
| 3,488,041 | 1/1970 | Powell et al. . | |
| 3,625,494 | 12/1971 | Allen . | |
| 3,764,290 | 10/1973 | Smith . | |
| 3,830,481 | 8/1974 | Dominguez et al. . | |
| 4,003,695 | 1/1977 | Kandakov | 432/214 |
| 4,005,982 | 1/1977 | Palz et al. | 432/217 |

*Primary Examiner*—John J. Camby

*Attorney, Agent, or Firm*—Watts, Hoffman, Fisher & Heinke Co.

[57] ABSTRACT

A hot blast stove for preheating combustion air for an associated blast furnace, having a continuous, substantially cylindrical shaped peripheral wall extending from a base to a domed cover. The peripheral wall includes a first cylindrical portion defined by a refractory ring wall of a predetermined thickness, surrounded by insulation, and enclosed by a continuous metal shell; and, a second, diametrically larger, cylindrical portion disposed above the first cylindrical portion, defined by a continuation of the refractory ring wall of the first portion, surrounded by a predetermined thickness of insulating brick and insulation. The second portion is enclosed by a continuous metal shell which joins the domed cover. An annular interconnecting portion joins the cylindrical portions and includes a metal shell that diverges outwardly from the metal shell of the first portion to obliquely join the metal shell of the cylindrical portion. The interconnecting metal shell provides support for tapered insulating bricks which in turn support the insulating brick in the second portion. Alternately, the interconnecting portion includes nontapered insulating bricks and castable insulation between the shell and the ringwall.

5 Claims, 5 Drawing Figures

BLAST FURNACE STOVE

BACKGROUND OF THE INVENTION

The present invention relates generally to blast furnace stoves and in particular to an improved blast furnace stove construction.

Blast furnace stoves, sometimes referred to as hot blast stoves, are employed in iron making to preheat the combustion air before entry into a blast furnace. Typically, a blast furnace stove will be a silo-shaped structure, constructed of refractory and insulating brick, and surrounded by a metal shell. Adjoining combustion and regenerative chambers are defined by a vertically extending internal dividing wall also constructed of refractory materials. The chambers communicate through a passage formed by a domed top.

The regenerative chamber, more commonly called checker chamber, includes tiers of refractory brick having aligned flow passages which extend from the top to the bottom of the chamber. The purpose of the checkerwork is to absorb and store heat from hot exhaust gases which pass through the checkerwork during a heating cycle. During this cycle, exhaust gases from an associated blast furnace are introduced and burned in the combustion chamber. The hot gases flow upwardly in the combustion chamber and then travel downwardly through the checkerwork, finally exiting at the bottom of the checker chamber. Once the checkerwork has attained a predetermined temperature, the heating cycle is terminated and the blast cycle begins.

In the blast cycle, outside air is introduced at the bottom of the checker chamber and travels upwardly through the checkerwork absorbing the stored heat. This preheated combustion air then travels down through the combustion chamber exits the stove and enters the blast furnace.

The internal operating temperature in the blast stove varies considerably and is well in excess of 2000° F. in certain portions of the chamber. For this reason, the outer wall of the blast stove must be heavily insulated. The insulation requirement for the outer wall, however, varies with the vertical height. The reason for this phenomonon is due to the operating nature of the blast stove. During the heating cycle, the hot gases which travel down through the checkerwork gradually cool during their descent. Consequently, the upper portions of the checkerwork will generally reach temperatures much higher than the lower portion of the checkerwork. This vertical temperature gradient which exists in the checker chamber during normal operation necessitates added insulation in the upper regions of the blast stove.

The prior art blast stove constructions have generally chosen a rather inefficient method for providing the needed additional insulation. The peripheral wall of a typical prior art stove is of a uniform thickness throughout its height and is constructed of refractory, insulating and metallic materials. Specifically, it will include a refractory ring wall surrounded by a metal shell and further include insulation between the shell and the ring wall. Because the upper regions of the blast furnace stove will require added insulation, the refractory ring wall in this region will include both "hard brick" and "insulating brick." The lower region of the blast stove, requiring less insulation, would include only hard brick. The thickness of this hard brick wall, however, would be equivalent to the total thickness of the hard brick and insulating brick wall employed in the upper region of the blast stove where more insulation was required. Thus, the added thickness of the lower portion of the blast stove wall merely serves to support the added insulating brick used in the upper portion of the blast stove. The increased thickness of the lower portion of the blast stove wall not only added unnecessary cost to the stove but more importantly reduced the volume of the checker chamber which lowered the total thermal capacity of the chamber. The need for adequate wall thickness to provide the necessary insulation coupled with the negative effect wall thickness has on checker chamber volume resulted in compromised constructions in prior art blast stoves. It has been found desirable to increase the checker chamber volume, if possible, without increased cost. Existing blast stoves are generally designed to operate up to twenty-five years before complete rebuilding. For the most part, the external dimensions of these blast stoves cannot be enlarged because their base area is constrained by the hardware and plumbing communicating with the blast furnace and located near the bottom of the stove. It is usually impractical to increase the overall diameter of the blast stove at the base to provide additional checker chamber volume. In the past, the prior art blast stoves have been renewed without change, and no improvement in checker chamber volume was realized as a result of rebuilding. Moreover, in cases where the blast stove diameter could be enlarged (i.e., a new installation) the expensive prior art construction method was retained, that is, the ring wall of the lower portion of the blast stove included an added thickness to support the insulating brick used in the upper portion of the stove.

SUMMARY OF THE INVENTION

The present invention provides a new and improved Blast Stove construction in which checker chamber volume is maximized without increasing the base area of the blast stove. When the construction of the invention is employed in rebuilding existing Blast Stoves, the checker chamber volume is increased without an attendant increase in the diameter of the base of the blast stove. When the construction is employed on a new blast stove, a reduction of required materials is realized thereby providing a cost savings over the prior art constructions.

According to a preferred embodiment of the invention, the blast stove includes a peripheral wall having an upper and lower section. The lower section includes a thickness of refractory brick, surrounded by a metallic shell and having insulation intermediate the refractory brick and the shell. The upper section includes a thickness of hard brick equal to the hard brick thickness of the lower section. Surrounding this refractory brick is a thickness of insulating brick which in turn is surrounded by insulation and finally by a metallic shell.

The hard brick ring wall is preferably uniform from the base to the top of the stove and is of a thickness determined by that required in the lower section of the stove. Insulation, preferably a composite block insulation, is provided between the hard brick ringwall and the shell. Additional insulating bricks surround the upper half of the ring wall only and extend beyond the outer diameter of the ring wall. This is provided in the upper portion of the stove that is subjected to higher temperatures. To accommodate this increased diameter, the metallic shell is diametrically larger in the upper half of the blast stove.

The blast stove preferably includes an annular interconnecting or transition section intermediate the lower and upper sections. The hard brick ring wall from the lower section extends through this interconnecting section without interruption to join the hard brick wall of the upper section. Preferably, tapered insulating bricks surround the hard brick wall in the interconnecting section and form a foundation shelf for the insulating brick surrounding the upper hard brick wall. A layer of insulation surrounds this insulating brick and in turn is surrounded by a metal shell portion which diverges outwardly from the metal shell of the lower section to join the metal shell of the upper section and provide a gradual increasing diameter. The insulation and the metal shell cooperate to provide some vertical support for the tapered insulating bricks.

An alternate construction for the interconnecting section is also provided by the present invention, which utilizes nontapered insulating bricks in the interconnecting section to form the foundation for the insulating bricks in the upper section. In this embodiment, the block insulation in the lower section (intermediate the ring wall and the metal shell) is terminated at the juncture of the interconnecting and lower blast stove sections. A first row of slightly reduced thickness insulating bricks sits on top and is partially supported by the block insulation of the lower section. Insulating bricks of uniform radial thickness surround the remainder of the ring wall in the interconnecting section and join with the insulating bricks surrounding the ring wall in the upper section. Castable insulation is used to fill the tapered gap between the outwardly diverging metal shell and insulating brick in the interconnecting section. Block insulation then begins at the juncture of the interconnecting and upper blast stove sections and surrounds the insulating brick of the upper section.

A significant advantage of the disclosed blast stove construction resides in the increase in checker volume that results due to the decrease in ring wall thickness provided in the lower section. This increased volume is accomplished without increasing the base area of the blast stove. Only the perimetric dimension of the upper half of the stove is increased where the diameter of the stove is not constrained by an adjoining hardware or plumbing.

DETAILED DESCRIPTION

Figure 1:
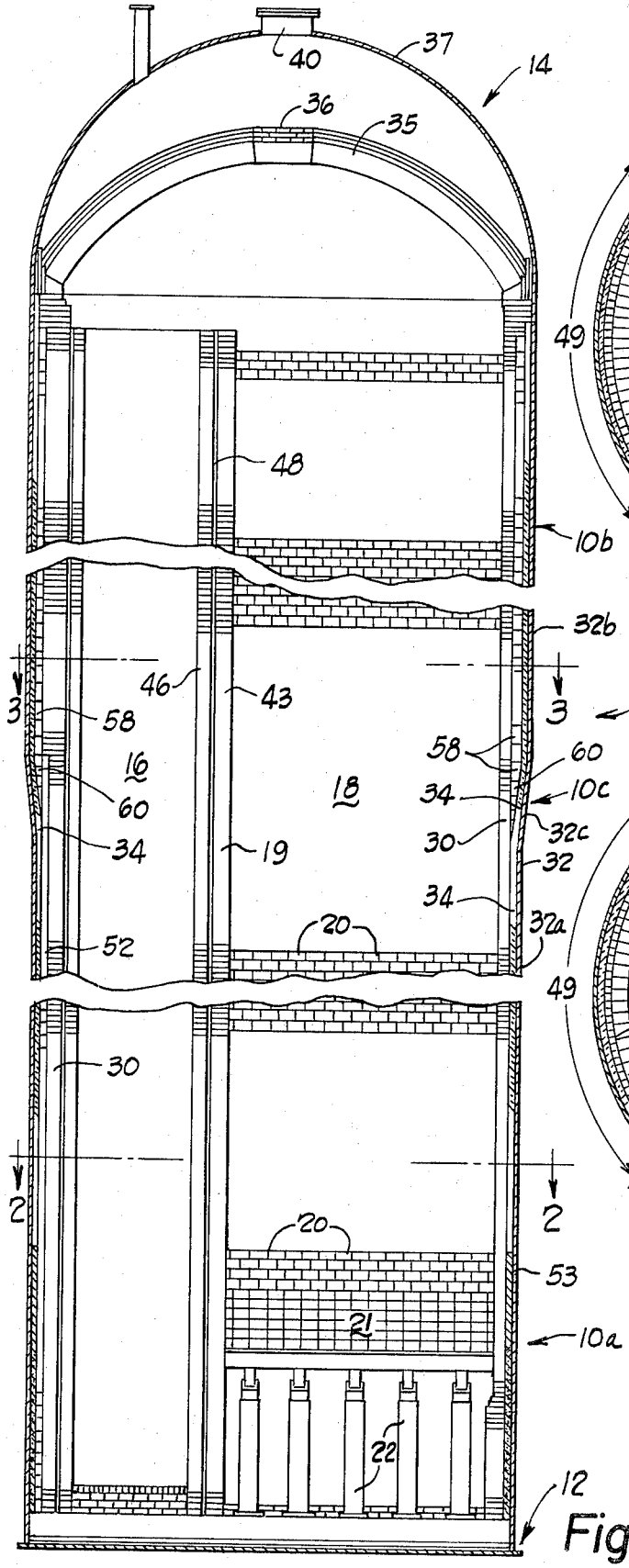
FIG. 1 is a cross sectional view of a blast stove constructed in accordance with the present invention.

FIG. 1 illustrates a blast stove constructed in accordance with a preferred embodiment of the invention. The blast stove is generally cylindrical in shape having a peripheral wall indicated generally by the reference character 10 extending from a base 12. The structure is capped by a dome assembly 14. The internal volume of the structure is divided into adjoining combustion and regenerative chambers 16, 18, by an internal refractory wall 19. Tiers of checkerbrick 20 are stacked within the checker chamber 18 to form a checkerwork 21 which fills major portion of the checker chamber volume. The checkerbrick 20 is supported by a checkerwork support structure 22 which generally comprises a series of interlocked metal columns, girders and grid bars. Various support structure configurations are known in the art and since the specific construction does not form a part of the invention, a detailed disclosure of a suggested construction is not included herein.

During the heating cycle, combustible exhaust gases from an associated blast furnace are introduced near the bottom of the combustion chamber 16 along with an appropriate amount of combustion air and ignited. The burning gases travel upwardly in the combustion chamber 16 and are deflected downwardly into the checker chamber 18 by the domed assembly 14. The gases then travel through aligned flow passages (not shown) in the checkerwork 21 and heat the individual checkerbricks. After traveling through the checker chamber, the gases exit through a port (not shown) near the bottom of the checker chamber 18.

In the blast cycle, air is introduced near the bottom of the checker chamber 18 and travels upwardly through the heated checkerbrick 20 and absorbs heat therefrom. It is then deflected by the domed assembly 14 and travels down through the combustion chamber and out a port (not shown) in the combustion chamber 16 from where it then travels to the blast furnace.

As explained earlier, the insulating requirement for the peripheral wall of the blast stove varies with the vertical height due to the operating nature of the stove. Specifically, additional insulation is needed in the upper portions of the blast stove.

The present invention provides a blast stove construction which fulfills the insulation requirements without adversely affecting checker chamber volume in either new or existing blast stoves.

Referring to FIG. 1, the peripheral wall 10 of the blast stove includes a ring wall 30 constructed of refractories, known as hard brick, surrounded by a metal containment shell 32. A layer of insulation 34 is located between the shell 32 and the ring wall 30. Like the peripheral wall 10, the domed assembly 14 includes a refractory sub-structure 35 enclosed by a metal roof 37. The refractory inner roof 35 is supported by the ring wall 30, and the roof 37 is attached to the metal shell 32. A port 36 is centrally disposed in the refractory roof 35 for the purpose of equalizing pressure on both exposed surfaces of the refractory roof. Thus, the metal shell 32 and the attached roof 37 serve to contain pressure within the structure and prevent air or gas leakage out of the chambers 16, 18. The metal roof 37 forming the dome cover, includes an access manhole 40.

Figure 3:
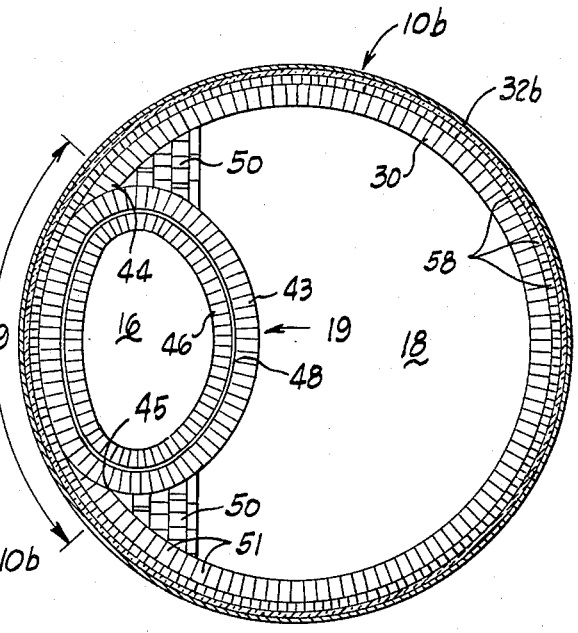
FIG. 3 is a cross sectional view of the blast stove of FIG. 1 taken along the line 3—3.
Figure 2:
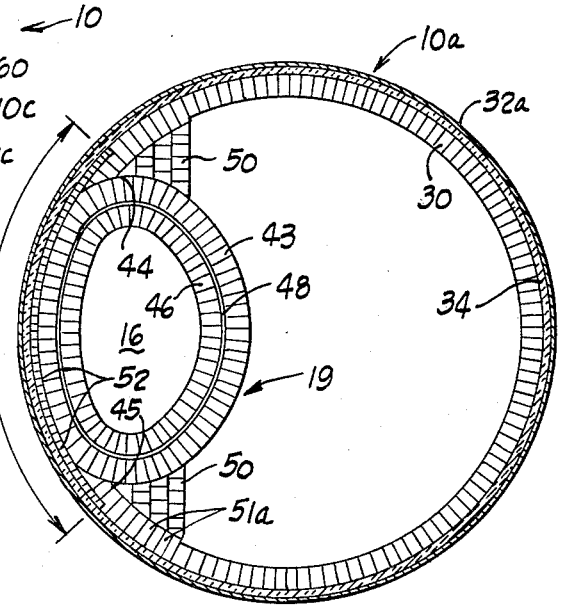
FIG. 2 is a cross sectional view of the blast stove in FIG. 1 taken along the line 2—2.

Referring to FIGS. 1, 2 and 3, the internal refractory wall 19 which defines the combustion chamber 16 is generally an oblated ellipse in cross-section. It comprises an oval shaped skin lining 46 and a breast wall 43 which merges into and joins the ring wall 30 at spaced locations indicated generally by the reference characters 44, 45. A gap 48 having insulation disposed therein is provided between the skin lining 46 and the breast wall 43 to allow relative movement between these walls, normally expected during blast stove operation due to differential expansion rates between the two walls. Although FIGS. 2 and 3 would indicate that the breast wall 43 is continuous and surrounds the skin lining 46, the portion of the breast wall which forms the peripheral extent of the blast stove is considered by those skilled in the art to be part of the ring wall 30. For this reason, the portion of the breast wall which forms the peripheral wall between the points 44, 45, for purposes of explanation will be considered as part of the ring wall 30.

The breast wall includes conventional reinforcement 50, commonly called monkeys, which each comprise a refractory construction which is "bonded" to the ring wall 30. The term "bonding" should be recognized by those skilled in the art to mean overlaying or interleaving the individual bricks of the ring wall 30 and the monkey 50. Specifically, FIG. 3 illustrates an even course of brick work and as such, the individual bricks 51 forming the ring wall 30 in the vicinity of the monkey are of the same length as the rest of the ring wall brick. However, FIG. 2 illustrates what would be termed an odd course of brick work. In this layer, the bricks 51*a* in the vicinity of the monkey are slightly longer and as a result partially overlay the peripheral bricks of the monkey in the underlying layer. By overlaying the monkey in alternate layers, a stronger interconnection, or "bonding" is accomplished.

As shown in FIG. 1, the peripheral wall 10 includes a lower section 10*a* and upper section 10*b* and a transitional or interconnecting section 10*c* joining the upper and lower sections 10*a*, 10*b*. The hard brick ring wall 30 is substantially uniform in all three sections 10*a*, 10*b*, 10*c* except in the area of the combustion chamber 16 as will be described.

Referring to FIG. 2, the ring wall 30 in the lower portion of the blast stove 10*a* is illustrated. The major portion of the ring wall 30, specifically, the portion that encloses the checker chamber 18 is constructed of a predetermined thickness of hard brick. For a blast stove having approximately a 20 foot diameter, a 9 inch thickness of hard brick has been found satisfactory.

The portion of the ring wall 30 that extends between the monkeys and forms the outside wall of the combustion chamber 16 (which for purposes of explanation is indicated by the reference character 49), includes not only the predetermined thickness of hard brick, but additionally includes a second predetermined thickness of insulating brick 52. For the size blast stove referenced above, a 4.5 inch thickness of insulating brick is satisfactory. As is noted above, certain layers of the ring wall, include slightly longer bricks 51*a* in the monkey areas to accomplish bonding between the ring wall 30 and the monkey.

The insulation 34 surrounds the ring wall 30 in the lower section 10*a* of the peripheral wall. As seen in FIG. 1, the layer of insulation 34 is generally uniform in all three sections 10*a*, 10*b*, 10*c*. Many forms of this insulation are available, one such material being a composite ceramic fiber and insulating block known under the trade name IV-20 and available from International Vermiculite. In a 20 ft. diameter blast stove, a 4 inch thickness of this insulation has been found appropriate. In the lower regions of the section 10*a* of the peripheral wall 10, a castable insulation is employed, designated by the reference character 53, to better seal around port openings in the lower regions of the blast furnace stove.

Referring to FIGS. 1 and 3, the upper section 10*b* of the peripheral wall 10 is of a larger diameter than the lower section 10*a* to accommodate the additional insulation requirement. The portion of the ring wall 30, in the upper section 10*b* of the peripheral wall 10 is of substantially the same construction as the portion of the ring wall 30 in the lower section 10*a* of the blast stove, the exception being in the portion of the wall 49, (shown in FIG. 3) which also forms the peripheral wall of the combustion chamber 16. In the upper section 10*b*, an increased thickness of hard brick is utilized for this section of the peripheral wall. For a 20 foot diameter blast stove, a satisfactory thickness is 13.5 inches.

Surrounding the ring wall 30 in the upper section 10*b* is a thickness of insulating brick 58. The insulating brick 58 forms a continuous wall which completely encircles the ring wall 30. A satisfactory thickness of insulating brick which fulfills the insulating requirement for a 20 ft. stove has been found to be 4.5 inches.

The upper section 10*b*, includes a layer of insulation 34 which surrounds the insulating brick. The insulation 34 is preferably a continuation of that included in the lower section, namely a ceramic fiber and insulating block. An upper section 32*b* of the metal shell surrounds this layer of insulation and as shown in FIG. 1, is of a larger diameter to accommodate the insulating brick which surrounds the ring wall 30.

Figure 4:
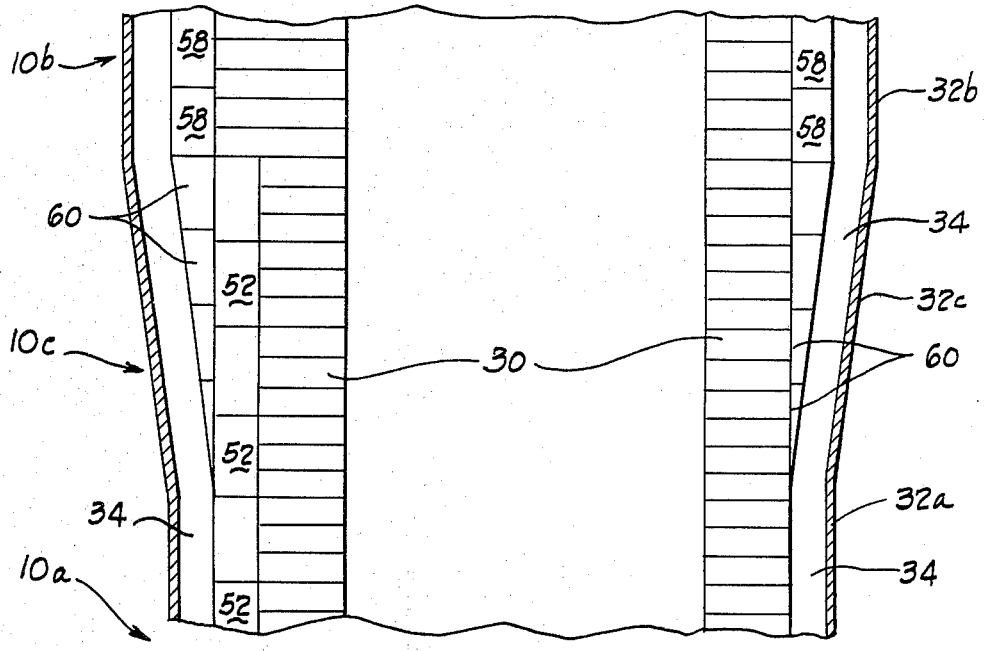
FIG. 4 is a cross sectional diagrammatic view of the preferred construction of the transition section of the blast stove with the internal combustion chamber wall omitted for clarity.

The transition section 10*c* of the peripheral wall 10 provides a gradual increasing diameter to join the lower and upper sections 10*a*, 10*b*. A preferred construction of the transition section is schematically shown in FIG. 4. For clarity, the internal combustion wall 19 has been omitted from this figure. Referring also to FIG. 1, the ring wall 30 extends through the transition section 10*c* without interruption. It should be noted, that in the preferred construction, the portion of the ring wall 49 (see FIGS. 1 and 2), which forms the exterior wall of the combustion chamber 16, continues unchanged from the lower section 10*a* through the transition section 10*c*. Specifically, in the transition section 10*c*, the portion of the wall 49 includes a thickness of hard brick and a thickness of insulating brick 52.

As shown in FIGS. 1 and 4, rows of vertically tapered insulating bricks 60 are attached to the ring wall 30. Each successive row is composed of increased thickness bricks so that a uniform taper is provided from the bottom to the top of the transition section 10*c*. These rows of vertically tapered insulating bricks 60 form a shelf upon which successive, vertically nontapered, rows of insulating brick 58 are supported.

The composite block insulation 34, which surrounds the ring wall 30 in a lower section 10*a* of the blast stove, continues uninterrupted through the transition section 10*c*. The block insulation 34 surrounds the rows of tapered insulating bricks 60 and in turn is surrounded by the transition portion 32*c* of the metal shell 32. The metal shell transition portion 32*c* provides a gradual increasing diameter to join the upper and lower sections of the metal shell 32*a*, 32*b*, and preferably diverges outwardly from the lower section 32*a* at an angle of approximately seven degrees from the vertical. Additionally, the shell portion 32*c* supplies some support for the tapered rows of insulating brick 60. As shown in FIG. 4, the tapered bricks are captured between the ring wall 30 and the insulation 34. The metal shell section 32*b*, in turn, supports the insulation 34. Thus, the lateral loading which is generated by the tapered bricks 60 when supporting the weight of the insulating brick 58 in the upper region, is born partially by both the ring wall 30 and the metal shell 32c.

To accommodate the additional stresses placed on the metal shell of the transitional section 32c, a thicker metal plate thickness is preferably utilized. In a 20 foot diameter blast stove constructed according to the present invention, a nominal shell thickness of $\frac{5}{8}$ inches has been found satisfactory for the upper and lower metal shell portions 32a, 32b. The transitional metal shell portion 32c, however, is preferably 1 inch thick to better support the additional lateral and vertical loads placed on the metal shell 32c by the tapered row of insulating bricks 60.

Figure 5:
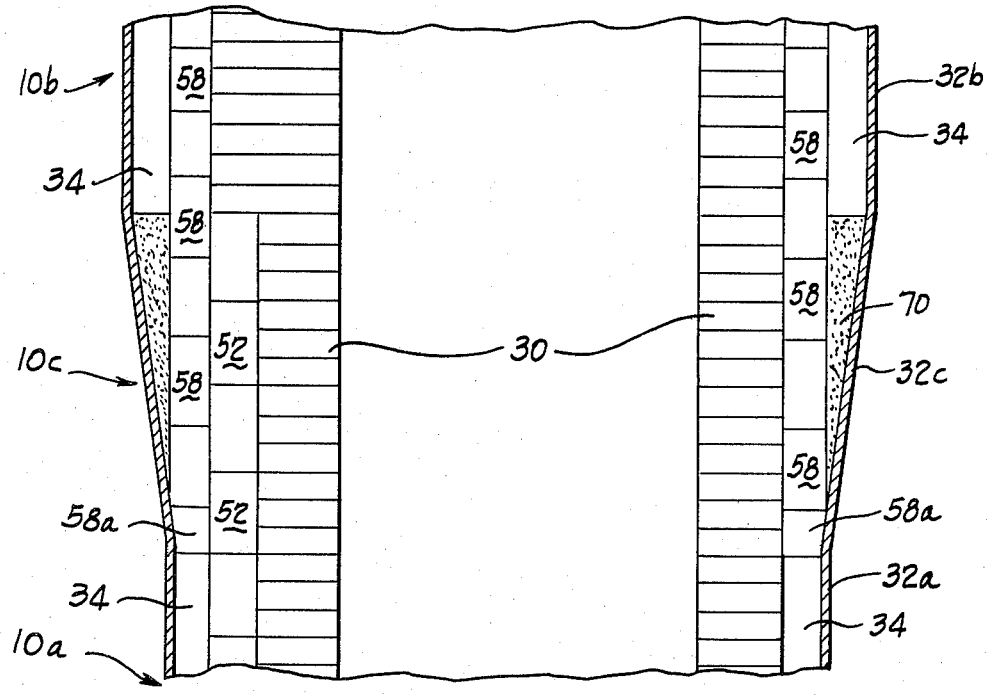
FIG. 5 is a cross sectional diagrammatic view of an alternate construction of the transition section of the blast stove with the internal combustion chamber wall omitted for clarity.

FIG. 5 illustrates schematically, an alternate construction for the transition section 10c of the blast stove. The disclosed construction has been found to be a less expensive construction for it avoids the use of the row of vertically tapered insulating brick 60. In the alternate construction, vertically nontapered insulating bricks 58 surround the ring wall 30 in the transition section 10c. Essentially, the added insulating brick 58 needed in the upper region 10c of the blast stove, begins at the lower end of the transition section 10c, a first row of insulating bricks 58a sitting on top of the block insulation 34 of the lower section 10a.

As discussed earlier, in a 20 foot blast furnace stove, the block insulation in the lower region of the stove 10a is approximately four inches. The insulating brick, however, is nominally 4.5 inches and for this reason the first row of insulating brick 58a must be slightly tapered and reduced in thickness where it joins the block insulation 34. The remaining rows of insulating brick in the transition section are of uniform thickness. Castable insulation 70 is poured between the insulating bricks 58 and the metal shell transition portion 32c to fill the void between the insulating bricks 58 and the metal shell 32c. In this embodiment, the block insulation 34 in the lower section of the blast stove 10a and the metal shell 32c provide some vertical support for the insulating brick 58 in the transition and upper sections 10a, 10c of the blast stove.

It should be apparent that a novel blast stove construction is disclosed which provides added insulation in the upper regions of a blast stove without adversely affecting the interior volume of the checker chamber. When the invention is incorporated on existing blast stoves, an increase in checker chamber volume is realized due to the decreased average thickness of the ring wall. When the invention is incorporated in building new blast stoves, a savings in material cost is realized.

Although the invention has been described with a certain degree of particularity, various changes and modifications can be made to it by those skilled in the art without departing from the spirit or scope of the invention as described and hereinafter claimed.

What is claimed is:

1. A blast furnace stove having a continuous peripheral wall of substantially circular cross section extending from a base to a domed cover, comprising:
- (a) a lower section including:
  - (i) a refractory ring wall of a predetermined thickness;
  - (ii) a lower metal shell having a substantially uniform diameter surrounding said ring wall;
  - (iii) a layer of insulation intermediate the ring wall and the metal shell;
- (b) an upper, diametrically larger, section disposed above the lower section including:
  - (i) a continuation of the refractory ring wall of the lower section;
  - (ii) a layer of insulating brick surrounding said ring wall in the upper section;
  - (iii) an upper metal shell having a substantially uniform diameter surrounding said insulating brick;
  - (iv) a layer of insulation intermediate the insulating brick and the upper metal shell;
- (c) an annular interconnecting section intermediate the lower and upper sections including:
  - (i) a continuation of the refractory ring wall of the lower section;
  - (ii) vertically tapered insulating bricks surrounding said refractory ring wall;
  - (iii) a layer of insulation surrounding said tapered insulating bricks;
  - (iv) an annular interconnecting metal shell portion which obliquely joins the lower metal shell and upper metal shell to provide a gradual increasing diameter from the lower section to the upper section of the peripheral wall, said shell providing some vertical support for the tapered insulating bricks.

2. The blast stove of claim 1 wherein said annular interconnecting portion diverges outwardly from said lower metal shell at an angle of substantially 7° from the vertical.

3. The blast stove of claim 1 wherein the shell thickness of said annular interconnecting shell portion is greater than the shell thickness of said upper and lower metal shells.

4. A blast furnace stove having a continuous peripheral wall of substantially circular cross section extending from a base to a domed cover, comprising:
- (a) a lower section including:
  - (i) a refractory ring wall of a predetermined thickness;
  - (ii) a lower metal shell having a substantially uniform diameter surrounding said ring wall;
  - (iii) a layer of insulation intermediate the ring wall and the metal shell;
- (b) an upper, diametrically larger, section disposed above the lower section including:
  - (i) a continuation of the refractory ring wall of the lower section;
  - (ii) a layer of insulating bricks surrounding said ring wall in the upper section;
  - (iii) an upper metal shell having a substantially uniform diameter surrounding said insulating brick;
  - (iv) a layer of insulation intermediate the insulating brick and the upper metal shell;
- (c) an annular interconnecting section intermediate the lower and upper sections including:
  - (i) a continuation of the refractory ring wall of the lower section;
  - (ii) a layer of insulating bricks surrounding said refractory ring wall, and joining said layer of insulating bricks in said upper section;
  - (iii) a tapering layer of insulation surrounding said insulating bricks;
  - (iv) an annular interconnecting metal shell portion surrounding said insulation which obliquely joins the lower metal shell and upper metal shell to provide a gradual increasing diameter from the lower section to the upper section of the peripheral wall.

5. A blast stove for preheating combustion air prior to entry into an associated blast furnace, comprising:

a vertical standing structure of substantially circular cross section defined by a peripheral wall extending vertically from a base, and terminating in and supporting a dome-shaped roof, the interior volume defined by said peripheral wall and dome top being divided into adjacent combustion and regenerative chambers by an curved breast wall that extends vertically from the base and terminates below the interior of said roof so that a passage is formed between the under surface of the roof and the breast wall, which communicates the combustion and regenerative chambers, said peripheral wall of said blast stove including an upper and lower section each having substantially uniform outside diameters, the diameter of said upper section being larger to accommodate an added thickness of insulation in said upper section of the peripheral wall, said sections being joined by an interconnecting section intermediate the lower and upper sections, said interconnecting section including an outer metal shell defining a gradual increasing diameter that diverges outwardly from said lower section, said transition section further including a tapered layer of insulation between said metal shell and an inner refractory ring wall.

* * * * *